US007178288B2

(12) United States Patent
Comtois

(10) Patent No.: US 7,178,288 B2
(45) Date of Patent: Feb. 20, 2007

(54) CONTAINER FOR BOUQUET PRESENTATION

(76) Inventor: André Comtois, 60 rue Comtois, St-Marc-sur-Richelieu, Quebec (CA) J0L 2E0

( * ) Notice: Subject to any disclaimer, the term of this patent is extended or adjusted under 35 U.S.C. 154(b) by 0 days.

(21) Appl. No.: 10/935,326

(22) Filed: Sep. 7, 2004

(65) Prior Publication Data

US 2006/0048445 A1 Mar. 9, 2006

(51) Int. Cl.
*A01G 9/02* (2006.01)

(52) U.S. Cl. ..... 47/72

(58) Field of Classification Search ..... 47/72
See application file for complete search history.

(56) References Cited

U.S. PATENT DOCUMENTS 5,937,576 A * 8/1999 Weder et al. ..... 47/72
6,018,908 A * 2/2000 Charrin et al. ..... 47/41.01
6,604,632 B2 * 8/2003 Weder ..... 206/423

FOREIGN PATENT DOCUMENTS

FR 2137325 * 12/1972
FR 2841215 A1 * 12/2003

* cited by examiner

*Primary Examiner*—Francis T. Palo
(74) *Attorney, Agent, or Firm*—Eric Fincham

(57) ABSTRACT

A flower container which is formed of a flexible plastic material having a sidewall extending upwardly from a base member, with a plurality of cutouts formed in the upper portion of the sidewall and a restricting member being secured about the upper portion of the sidewall to thereby form a shoulder section which extends inwardly to a neck and an upper section which extends upwardly and outwardly from the restricted neck portion. The container may be utilized with normally scrapped flowers and distributed to various types of retail outlets.

8 Claims, 3 Drawing Sheets

CONTAINER FOR BOUQUET PRESENTATION

FIELD OF THE INVENTION

The present invention relates to a container and more particularly, relates to a container and decorative assembly for a floral grouping. There is also taught a method for the use of flowers which are considered as a lost material.

BACKGROUND OF THE INVENTION

The use of containers for holding cut flowers is extremely old and well known in the art. In the field of commercial florists, flowers are typically shipped from their place of growing which is frequently located in a relatively low cost country to a central distribution or wholesale point. From this point, flowers are then dispatched in the required quantities to individual florists who make up arrangements as required.

In preparing the flowers for retail sales, the florists typically display the flowers in a vase or other suitable container which holds the flowers and water along with any additives such as nutrients, preservatives and the like.

During shipping, frequently some of the stems of the flowers become broken and these flowers are not suitable for sale. Accordingly, they are usually disposed of as scrap.

SUMMARY OF THE INVENTION

It is an object of the present invention to provide a method for the recovery of otherwise scrap flowers and for the sale thereof.

It is a further object of the present invention to provide a decorative container which may be used for such scrap flowers.

According to one aspect of the present invention, there is provided a container for flowers comprising a base member, a body formed of a flexible plastic material having a sidewall extending upwardly from the base member, a plurality of cutouts in an upper portion of the sidewall, a restricting member secured about the upper portion of the sidewall such that there is formed a shoulder section extending inwardly to the restricting member, and an upper section extending upwardly and outwardly from the restricting member.

In a further aspect of the invention, there is provided, in combination, a container comprising a base member, a body formed of a flexible plastic material having a sidewall extending upwardly from the base member, a plurality of cutouts in an upper portion of the sidewall, a restricting member secured about the upper portion of the sidewall such that there is formed a shoulder section extending inwardly to the restricting member, and an upper section extending upwardly and outwardly from the restricting member, an outer decorative material extending about the container, and a plurality of flowers placed within the container, the container having water in a lower portion thereof.

In a still further aspect of the invention, there is provided a method for recycling normally scrap flowers having broken stems, the method comprising the steps of cutting the stems at or above the point where the stem is broken, supplying a container as set forth above, partially filling the container with water, inserting the trimmed flowers in the container, applying a decorative wrap material about the container and distributing the flowers and containers to a retail outlet.

As used herein, the sheet of material may be of any suitable flexible material which is capable of being formed into the container. Frequently, the sheet of material is selected from a polymeric material which may include, without limitting the same, polypropylene, polyethylene, cellophane, etc. The sheet of material may be of any thickness and would generally range between 0.1 ml to about 40 ml. A preferred range would be in between 1 ml and 5 ml.

The sheet of material may be formed of a single layer or a plurality of layers of a same or dissimilar material. The material is preferably clear although a decorative pattern could be applied thereto and in particular, to the upper portion if so desired.

The term decorative material as used herein means any material which is flexible and capable of being wrapped about the container. The material may comprise a plastic material, paper material, or the like. Thus, it may be formed and decorated for the particular purpose or alternatively, commercially available wrapping material may be utilized.

In the method aspect of the present invention, the scrapped flowers which are normally disposed of in the garbage may be utilized in the container of the present invention. Thus, such scrap flowers would be trimmed at a point at or above the point at which the stem is broken. It suffices to say that the stems would be trimmed to have a length suitable for the container. A water containing nutrients and/or preservatives is placed in the bottom portion of the container and the flowers inserted. A decorative material may then be applied about the container. The completed container can then be taken to a retail outlet which typically would not be a florist or the like. Rather, the containers containing the flowers can now be sold at outlets such as drugstores, convenience stores, and the like. Typically, the containers and flowers may be positioned at a cashier position.

In preferred embodiments of the present invention, the lower marginal edges defining the cutouts preferably have at least an equal or a longer length than the upper marginal edges. This in turn, defines the shoulder of the container as well as the upper sections. Preferably, the lower marginal edges extend between 50 and 75 percent of the total length of the upper and lower marginal edges.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 2:
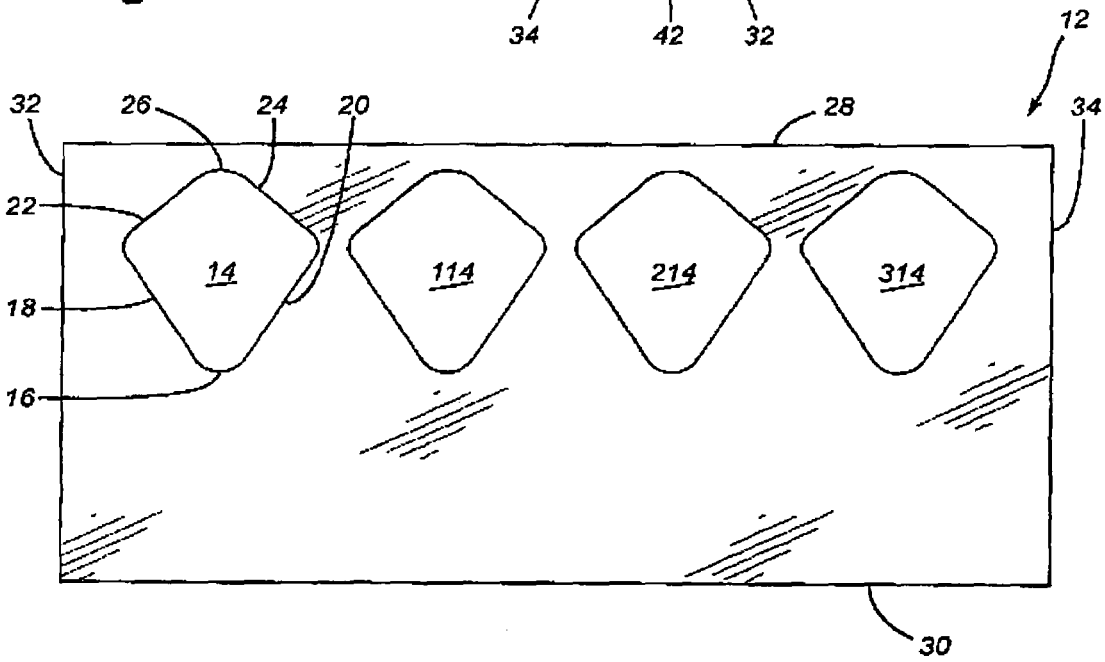
FIG. 2 is a plan view of the sheet of material used to form the sidewall portion of the container of FIG. 1.

Referring to the drawings in greater detail and by reference characters thereto, there is illustrated in FIG. 2 a piece of material which is utilized to form the sidewall of the container and which material is generally designated by reference numeral 12. Sheet material 12 is defined by an upper marginal edge 28, a lower marginal edge 30, and side marginal edges 32 and 34 which together provide a rectangular configuration for sheet material 12. Sheet material 12 has a plurality of cutouts 14, 114, 214 and 314 formed therein. Since each of the cutouts is substantially identical, only one will be described in detail herein.

Cutout 14 is defined by a lower rounded edge 16 with a pair of lower side marginal edges 18 and 20 extending outwardly therefrom. Upper side marginal edges 22, 24 merge with edges 18 and 20 respectively and meet an upper rounded edge 26. Thus, as may be seen from FIG. 2, each cutout has a somewhat diamond shaped configuration although it will be noted that lower side marginal edges 18, 20 are of a greater length than upper side marginal edges 22, 24.

Sheet material 12 is defined by an upper marginal edge 28, a lower marginal edge 30, and side marginal edges 32 and 34 which together provide a rectangular configuration for sheet material 12.

Figure 3:
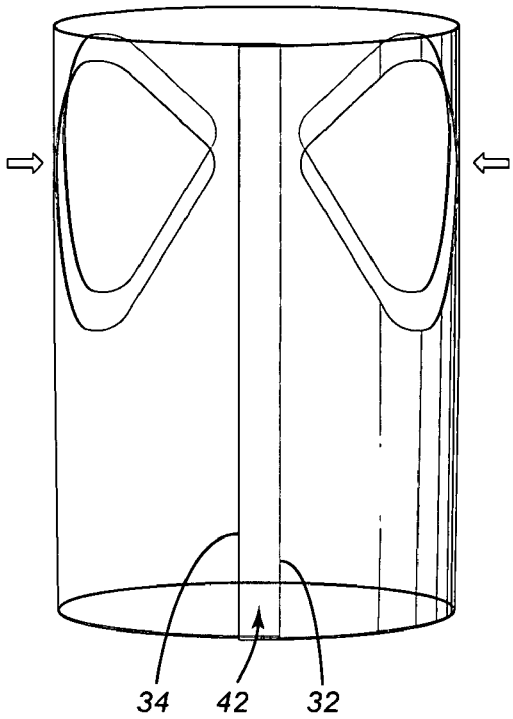
FIG. 3 is a side view of the material of FIG. 1 formed into a cylindrical configuration.
Figure 5:
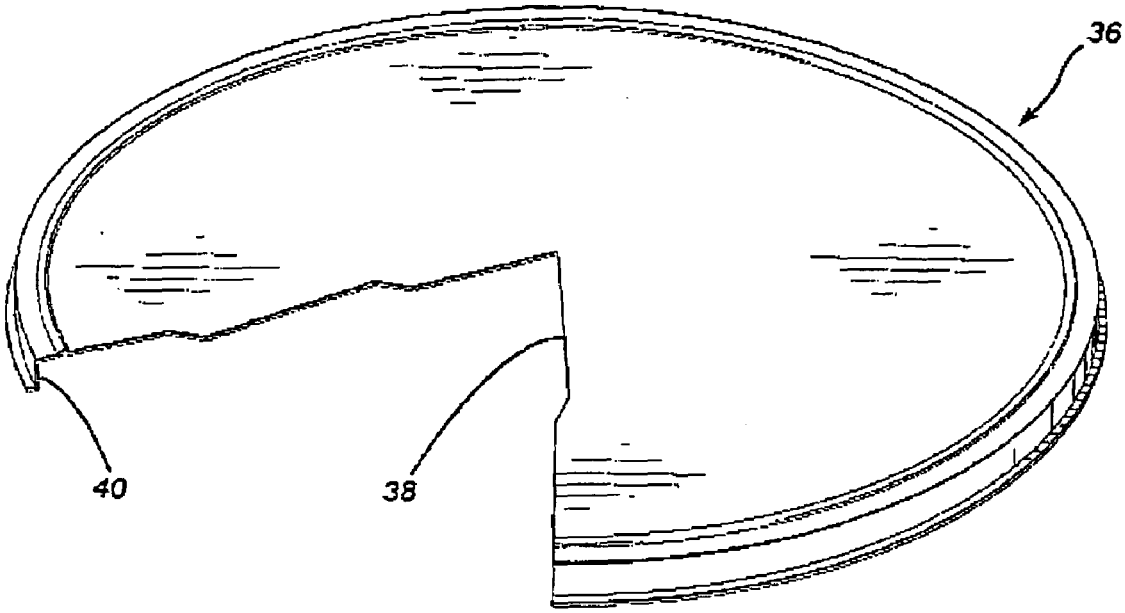
FIG. 5 is a perspective view of a base portion of the container.

For assembly, and as may be seen in FIG. 3, sheet material 12 is formed into a cylindrical tube configuration with side marginal edges 32, 34 overlapping. The overlapping provides an adhesive zone 42 wherein an adhesive is applied. A base 36, as shown in FIG. 5, has a bottom wall 38 with a downwardly extending sidewall 40. Base 36 is sized such that it fits interiorly of the bottom portion of the sidewall and is secured thereto, typically by adhesive.

Figure 1:
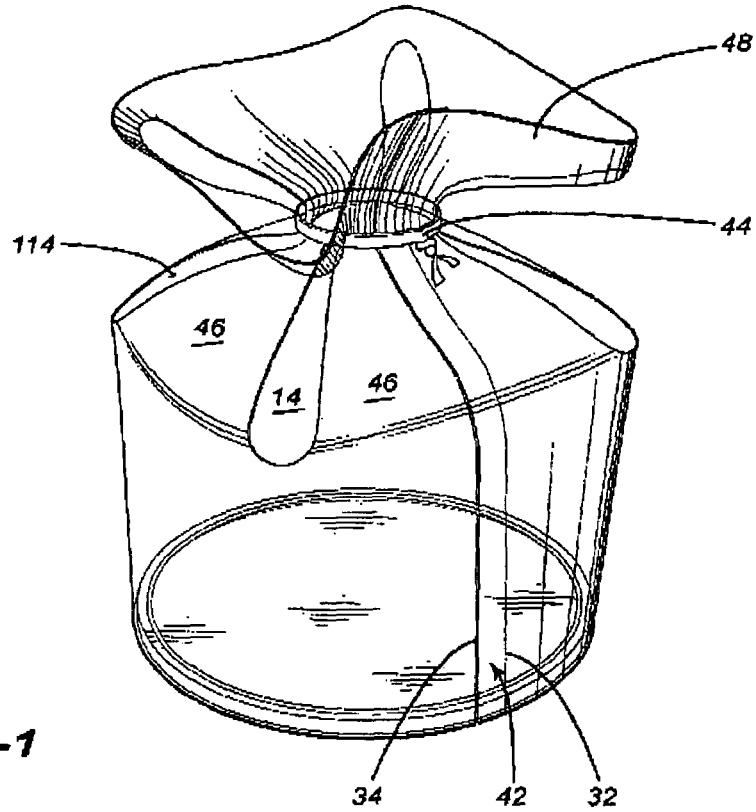
FIG. 1 is a perspective view of the container according to the present invention.

As may be seen in FIG. 1, a restraining member 44, which may be a cable tie, is utilized to form a restricted neck portion. In so doing, a shoulder section 46 is formed and which shoulder section 46 extends inwardly and upwardly from the sidewall. Subsequently, an upper section 48 extends upwardly and outwardly. It will be noted that restraining member 44 extends about that portion where lower side marginal edges 18, 20 meet upper side marginal edges 22, 24. Restraining member 44 may be any suitable material including elastics, cable ties, strings, etc.

Figure 4:
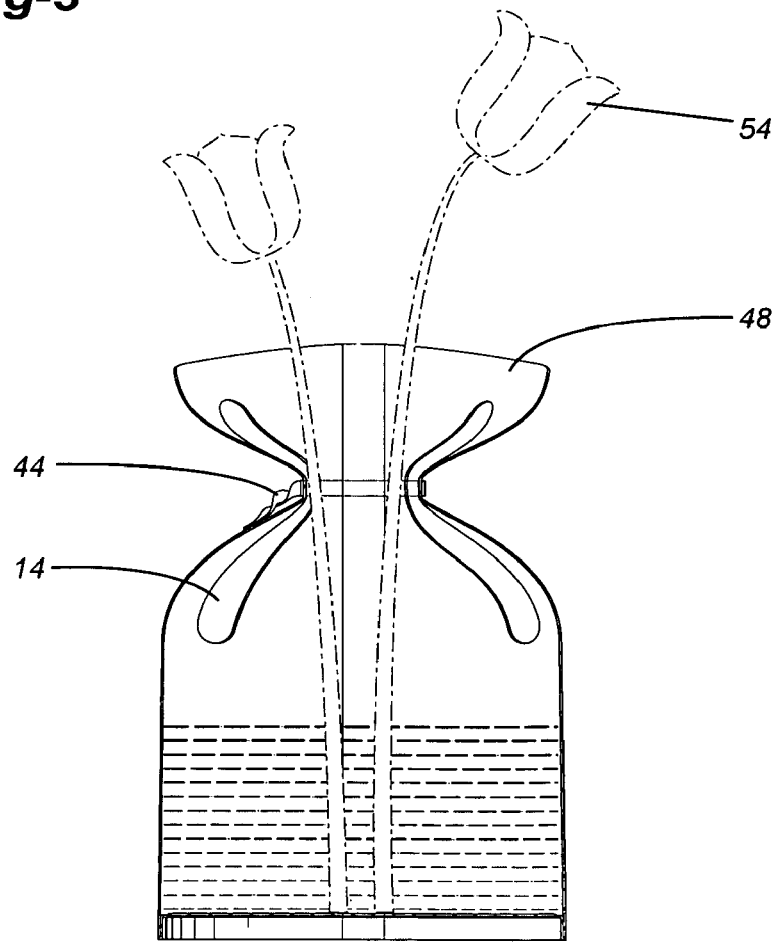
FIG. 4 is a side elevational view of the assembled container.
Figure 6:
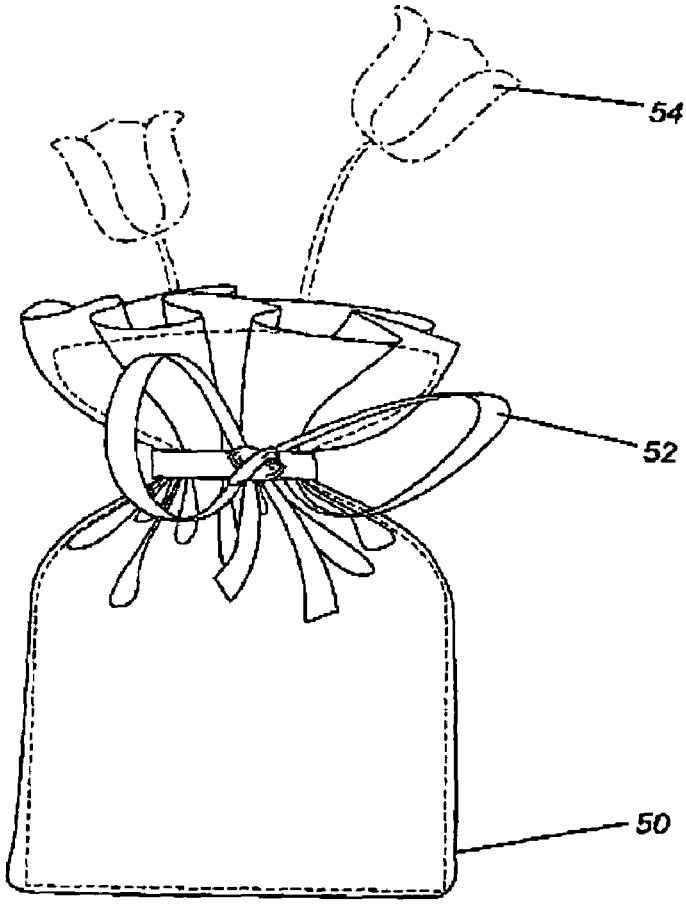
FIG. 6 is a side elevational view of the container with a decorative wrap.

In a preferred embodiment, and shown in FIG. 6, a decorative wrapping material 50 may be applied about the container with a tie 52 extending about the neck. Alternatively, material 50 may be of a cling wrap type which will naturally tend to adhere to the container. Flowers 54 are placed within the container with water preferably being present as shown in FIG. 4.

It will be understood that the above described embodiment is for purposes of illustration only and that changes or modifications may be made thereto without departing from the spirit and scope of the invention.

I claim:

1. A container for flowers comprising:

a base member a body formed of a flexible plastic material having a sidewall extending upwardly from said base member;

a plurality of generally diamond shaped cutouts in an upper portion of said sidewall, a restricting member secured about said upper portion of said sidewall and said cutouts such that there is formed a shoulder section extending inwardly to said restricting member, and an upper section extending upwardly and outwardly from said restricting member.

2. The container of claim 1 wherein each of said cutouts is further defined by first and second lower marginal edges and first and second upper marginal edges.

3. The container of claim 2 wherein said lower marginal edges have a greater length than respective upper marginal edges.

4. The container of claim 2 wherein said restraining member comprises a cable tie.

5. The container of claim 2 further including an outer layer of a decorative material extending about said container.

6. The container of claim 5 wherein said outer decorative material is of a cling wrap material.

7. The container of claim 5 wherein said outer layer of decorative material is retained in position by means of a tie.

8. In combination, a container comprising:

a base member;

a body formed of a flexible plastic material having a sidewall extending upwardly from said base member;

a plurality generally diamond shaped of cutouts in an upper portion of said sidewall;

a restricting member secured about said upper portion of said sidewall such that there is formed a shoulder section extending inwardly to said restricting member, and an upper section extending upwardly and outwardly from said restricting member;

an outer decorative material extending about said container; and a plurality of flowers placed within said container, said container having water in a lower portion thereof.

* * * * *